US010877386B2

(12) United States Patent
Murayama et al.

(10) Patent No.: US 10,877,386 B2
(45) Date of Patent: Dec. 29, 2020

(54) TONER

(71) Applicant: CANON KABUSHIKI KAISHA, Tokyo (JP)

(72) Inventors: Ryuji Murayama, Nagareyama (JP); Junichi Tamura, Toride (JP); Kentaro Kamae, Kashiwa (JP); Hayato Ida, Toride (JP); Daisuke Yamashita, Matsudo (JP); Masaharu Miura, Toride (JP); Takaho Shibata, Tokyo (JP); Wakiko Katsumata, Kashiwa (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/532,887

(22) Filed: Aug. 6, 2019

(65) Prior Publication Data

US 2020/0057397 A1 Feb. 20, 2020

(30) Foreign Application Priority Data

Aug. 14, 2018 (JP) ..... 2018-152731
Apr. 22, 2019 (JP) ..... 2019-081288
Jul. 10, 2019 (JP) ..... 2019-128583

(51) Int. Cl.
*G03G 9/08* (2006.01)
*G03G 9/113* (2006.01)
(Continued)

(52) U.S. Cl.
CPC ..... *G03G 9/0819* (2013.01); *G03G 9/0823* (2013.01); *G03G 9/09725* (2013.01);
(Continued)

(58) Field of Classification Search
CPC ..... G03G 9/0823; G03G 9/0821
See application file for complete search history.

(56) References Cited

U.S. PATENT DOCUMENTS 7,833,687 B2 11/2010 Kato et al.
8,084,174 B2 12/2011 Hasegawa et al.
(Continued)

FOREIGN PATENT DOCUMENTS

JP H04-316056 11/1992
JP 2006-145800 6/2006
(Continued)

OTHER PUBLICATIONS

U.S. Appl. No. 16/377,591, filed Apr. 8, 2019, Daisuke Yamashita.
(Continued)

*Primary Examiner* — Peter L Vajda
(74) *Attorney, Agent, or Firm* — Venable LLP

(57) ABSTRACT

A toner comprises a toner particle and an external additive, the toner satisfies a certain relationship with regard to σl ($C/m^2$) and σs ($C/m^2$). The toner is divided into two groups i.e. a first group and a second group with inertial classifier, the first group including a larger size of the toner particles, and the second group including a smaller size of the toner particles, and the number of the toner particles in the first group being substantially equal to the number of the toner particles in the second group. Then, al ($C/m^2$) represents an absolute value of average surface charge density of the toner included in the first group, and σs ($C/m^2$) represents an absolute value of average surface charge density of the toner included in the second group.

17 Claims, 1 Drawing Sheet

(51) Int. Cl.
*G03G 9/107* (2006.01)
*G03G 9/097* (2006.01)

(52) U.S. Cl.
CPC ..... *G03G 9/09775* (2013.01); *G03G 9/1075* (2013.01); *G03G 9/1136* (2013.01)

(56) References Cited

U.S. PATENT DOCUMENTS

| | | | |
|---|---|---|---|
| 8,323,726 | B2 | 12/2012 | Naka et al. |
| 8,349,069 | B2 | 1/2013 | Seitoku |
| 8,697,327 | B2 | 4/2014 | Shibata et al. |
| 8,921,023 | B2 | 12/2014 | Baba et al. |
| 8,927,188 | B2 | 1/2015 | Naka et al. |
| 8,974,994 | B2 | 3/2015 | Kamae et al. |
| 8,986,914 | B2 | 3/2015 | Fujikawa et al. |
| 9,057,970 | B2 | 6/2015 | Ida et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,348,247 | B2 | 5/2016 | Ida et al. |
| 9,372,420 | B2 | 6/2016 | Mizo et al. |
| 9,482,977 | B2 | 11/2016 | Obara et al. |
| 9,540,483 | B2 | 1/2017 | Ida et al. |
| 9,665,021 | B2 | 5/2017 | Ohtsu et al. |
| 9,665,023 | B2 | 5/2017 | Kamae et al. |
| 9,671,707 | B2 | 6/2017 | Minagawa et al. |
| 9,696,644 | B2 | 7/2017 | Ida et al. |
| 9,897,934 | B2 | 2/2018 | Tamura et al. |
| 9,915,885 | B2 | 3/2018 | Katsumata et al. |
| 9,969,834 | B2 | 5/2018 | Ohtsu et al. |
| 10,012,918 | B2 | 7/2018 | Ishigami et al. |
| 10,012,920 | B2 | 7/2018 | Shibata et al. |
| 10,012,921 | B2 | 7/2018 | Kamae et al. |
| 10,078,281 | B2 | 9/2018 | Ida et al. |
| 10,088,765 | B2 | 10/2018 | Miyakai et al. |
| 10,133,201 | B2 | 11/2018 | Kamae et al. |
| 10,175,595 | B2 | 1/2019 | Onozaki et al. |
| 10,197,936 | B2 | 2/2019 | Onozaki et al. |
| 10,203,619 | B2 | 2/2019 | Yamashita et al. |
| 10,216,108 | B2 | 2/2019 | Iwasaki et al. |
| 10,228,629 | B2 | 3/2019 | Tamura et al. |
| 10,234,777 | B2 | 3/2019 | Ohtsu et al. |
| 10,353,312 | B2 | 7/2019 | Kamae et al. |
| 10,423,090 | B2 | 9/2019 | Ohtsu et al. |
| 10,451,990 | B2 | 10/2019 | Kamae et al. |
| 2009/0111042 | A1* | 4/2009 | Kiyono ..... G03G 9/1135 430/108.6 |
| 2013/0108955 | A1 | 5/2013 | Shibata et al. |
| 2013/0244159 | A1 | 9/2013 | Ishigami et al. |
| 2014/0134535 | A1 | 5/2014 | Baba et al. |
| 2014/0137428 | A1 | 5/2014 | Takenaka et al. |
| 2015/0099227 | A1 | 4/2015 | Ida et al. |
| 2018/0275540 | A1 | 9/2018 | Matsuo et al. |
| 2019/0107793 | A1 | 4/2019 | Tamura et al. |

FOREIGN PATENT DOCUMENTS

| | | |
|---|---|---|
| JP | 2011-006622 | 1/2011 |
| JP | 2016-128885 | 7/2016 |

OTHER PUBLICATIONS

U.S. Appl. No. 16/438,537, filed Jun. 12, 2019, Kentaro Kamae.
U.S. Appl. No. 16/438,541, filed Jun. 12, 2019, Takeshi Hashimoto.
U.S. Appl. No. 16/438,544, filed Jun. 12, 2019, Kazuhisa Shirayama.
U.S. Appl. No. 16/534,343, filed Aug. 7, 2019, Kentaro Kamae.
U.S. Appl. No. 16/539,245, filed Aug. 13, 2019, Ryuji Murayama.

* cited by examiner

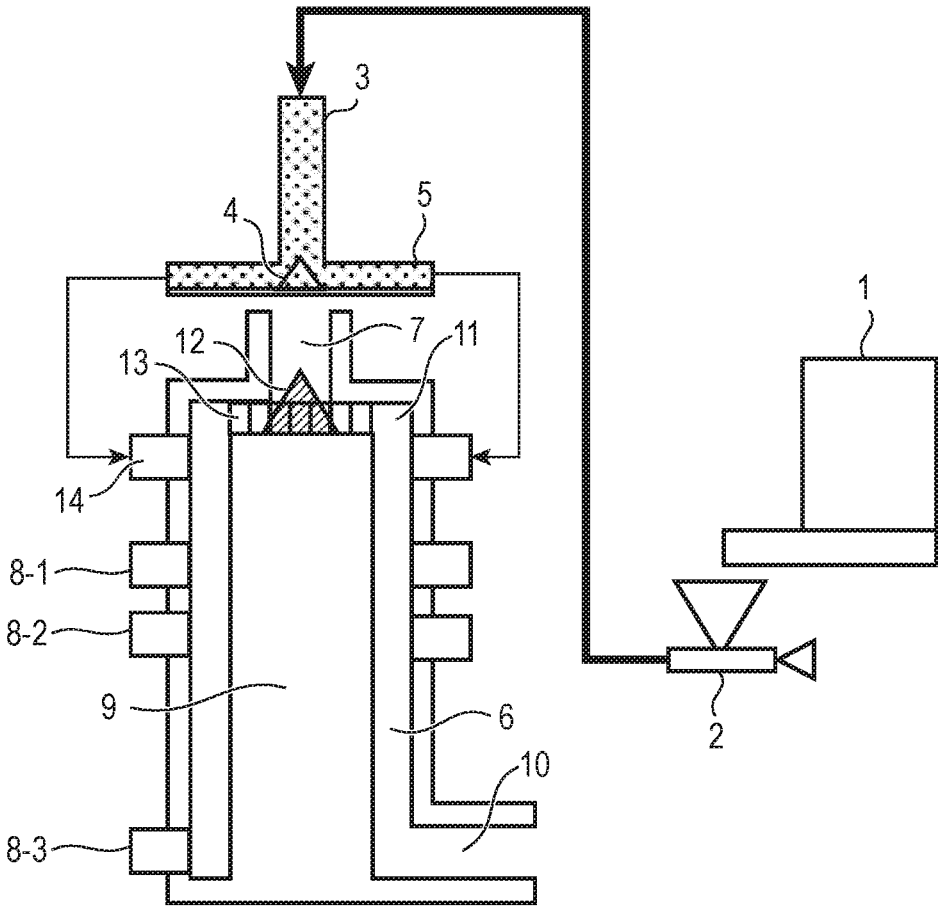
3
4
5
1
12
7
11
13
14
8-1
8-2
9
6
2
10
8-3

TONER

BACKGROUND OF THE INVENTION

Field of the Invention

The present invention relates to a toner for use in, for example, electrophotography, electrostatic recording, and electrostatic printing.

Description of the Related Art

Widespread use of electrophotographic, full-color copying machines in recent years has been demanding stability in image concentration, let alone higher copying speeds and higher image qualities.

A specific approach for improvement in image quality is production of toner with smaller particle size, which is expected to lead to higher dot reproducibility.

Japanese Patent Application Laid-Open No. 2016-128885, in the pursuit of better dot reproducibility, discloses a toner characterized by smaller particle sizes and a sharp particle size distribution.

Japanese Patent Application Laid-Open No. 2006-145800 discloses an approach for improvements of electric chargeability and yield in toners variable in particle size distribution. In the toner described in this document, the coating ratio of silica fine particles is adjustable correspondingly to different ranges of particle sizes.

For better stability in image concentration, toners are desirably developed that can avoid excessive electric charge amount in low humidity environments.

Japanese Patent Application Laid-Open No. H04-316056 discloses a toner designed to control external additive loading in order to prevent unnecessary increase of electric charge amount in low humidity environments.

In the toners disclosed in Japanese Patent Application Laid-Open Nos. 2016-128885 and H04-316056, the coating ratios of inorganic fine particles and shell layers are uniform irrespective of particle sizes, and charge densities on surfaces of these toners are accordingly uniform irrespective of particle sizes. A toner has a smaller surface area with smaller particle sizes, and an electric charge amount per particle of the toner is correspondingly smaller. The toner with smaller particle size with less electric charge amount may fail to follow an electrical field, which may adversely affect the transfer process in electrophotography. Specifically, transferability of the toner may be undermined when the transfer is attempted from an electrostatic latent image-bearing member to an intermediate transfer member or a medium through the electrical field.

In the AC development system, pullback bias may weaken a force to detach the toner from the electrostatic latent image-bearing member. As a result, the toner may remain attached to the electrostatic latent image-bearing member, possibly causing the event called fog.

If more inorganic fine particles are added to the toner in order to increase the electric charge amount per particle of the toner with smaller particle size, an electric charge amount per unit mass of the toner may be overabundant, which may allow only a minor amount of toner for the electrostatic latent image to be filled. This may result in an adequate image concentration, thus leading to instability in image concentration.

The toner disclosed in Japanese Patent Application Laid-Open No. 2006-145800, in which the coating ratio of inorganic fine particles is adjustable for different ranges of particle sizes, may have different surface charge densities depending on particle sizes. The invention of Japanese Patent Application Laid-Open No. 2006-145800 is characterized by the coating ratio adjustability in order to reduce electric chargeability of the toner with smaller particle size. This feature may lead to poor transferability, resulting in the occurrence of fog.

SUMMARY OF THE INVENTION

To this end, the present invention is directed to providing a toner that excels in dot reproducibility, transferability, and stability in image concentration and that can suppress the occurrence of fog.

The present invention provides a toner comprising a toner particle and an external additive, the toner satisfy a relationship expressed by the following formula (1);

$$0.10 \leq \sigma l / \sigma s \leq 0.75 \quad (1),$$

where when the toner is divided into two groups, i.e. a first group and a second group with an inertial classifier, the first group including a larger size of the toner particles, and the second group including smaller size of the toner particles, and the number of the toner particles in the first group being substantially equal to the number of the toner particles in the second group, $\sigma l$ ($C/m^2$) represents an absolute value of average surface charge density of the toner included in the first group, and $\sigma s$ ($C/m^2$) represents an absolute value of average surface charge density of the toner included in the second group.

Further features of the present invention will become apparent from the following description of exemplary embodiments with reference to the attached drawing.

BRIEF DESCRIPTION OF THE DRAWINGS

FIGURE is a drawing of a thermal spheronizing device used in the production of a toner according to the present invention.

DESCRIPTION OF THE EMBODIMENTS

In the present invention, numerical ranges described herein, for example, " . . . or more and . . . or less" and " . . . to . . . " include end points of the respective numerical ranges; upper-limit and lower-limit values, unless otherwise specifically noted.

The present invention provides a toner comprising a toner particle and an external additive, the toner satisfy a relationship expressed by the following formula (1);

$$0.10 \leq \sigma l / \sigma s \leq 0.75 \quad (1),$$

where when the toner is divided into two groups, i.e. a first group and a second group with an inertial classifier, the first group including a larger size of the toner particles, and the second group including smaller size of the toner particles, and the number of the toner particles in the first group being substantially equal to the number of the toner particles in the second group, $\sigma l$ ($C/m^2$) represents an absolute value of average surface charge density of the toner included in the first group, and $\sigma s$ ($C/m^2$) represents an absolute value of average surface charge density of the toner included in the second group.

As described earlier, the toners with smaller particle sizes, as described in the patent literatures mentioned above, should desirably be improved in image concentration stability, transferability, and fog preventability.

To address these issues of the known art, the inventors of the present invention discussed and studied how such toners are obtainable that can form high-quality images and provide improved image concentration stability, transferability, and fog preventability. An attempt to reduce toner particle sizes in order to improve image quality may result in a smaller surface area per toner particle and a correspondingly smaller electric charge amount per toner particle, possibly leading to poor transferability and failure to prevent the occurrence of fog. The techniques of the known art suggested for increase of the toner's electric charge amount can only supply a minor amount of toner for the electrostatic latent image to be filled. Thus, these techniques may indeed achieve improved transferability and fog preventability, however, only at the cost of desirable image concentration and stability in image concentration.

Through further discussions and studies, differently sized particles of a toner were found to be attributable to degradations of stability in image concentration, transferability, and fog preventability.

Specifically, the transferability and fog preventability may be more likely with finer toner particles each having a smaller electric charge amount. On the other hand, stability in image concentration may be compromised by the fact that an electric charge amount in a toner, if increased as conventionally done, inevitably increases in coarse particles larger in per-particle mass as well as in fine particles, consequently increasing the electric charge amount per unit mass. Therefore, the inventors were convinced that the issues of the known art were solvable by undertaking measures appropriate for toner particles that variously differ in particle size.

The toner satisfies the relationship expressed by the following formula (1);

$$0.10 \leq \sigma l/\sigma s \leq 0.75 \quad (1).$$

The toner is divided into two groups i.e. a first group and a second group with inertial classifier. The first group includes a larger size of the toner particles, and the second group includes a smaller size of the toner particles, and the number of the toner particles in the first group is substantially equal to the number of the toner particles in the second group. Then, $\sigma l$ ($C/m^2$) represents an absolute value of average surface charge density of the toner included in the first group, and $\sigma s$ ($C/m^2$) represents an absolute value of average surface charge density of the toner included in the second group. The method for dividing the toner into the first group containing a larger size of the toner particles and the second group containing a smaller size of the toner particles will be described later.

Both the first group and the second have a distribution with respect to the particle size. The first group and the second group have a relation that a median diameter of the toner in the first group is larger than a median diameter of the toner in the second group. It should be noted that the first group and the second group do not have a relation that a smallest particle in the first group is larger than the largest particle in the second group.

The values of $\sigma s$ and $\sigma l$ that satisfy the relationship expressed by the formula 1) may provide the following advantages: an increased electric charge amount in each of toner with smaller particle size, which may improve transferability and fog preventability of the toner with smaller particle sizes; and a decreased electric charge amount in each of toner with larger particle size, which may avoid excessive increase of the electric charge amount per unit mass of the toner and may also enhance stability in image concentration.

The values of $\sigma s$ and $\sigma l$ may preferably satisfy the relationship expressed by the following formula (2);

$$0.10 \leq \sigma l/\sigma s \leq 0.67 \quad (2).$$

By allowing the values of $\sigma s$ and $\sigma l$ to satisfy the relationship expressed by the formula 2), toner particles, electric field flight of which is relatively weak, may be reduced, and the transferability and fog preventability may be further improved.

The surface charge density in the toner may be measured by the following method.

First, the toner is electrically charged by friction as described below.

In an environment at 23° C. and at 50% RH, 0.7 g of the toner and 9.3 g of a standard carrier (N-01) according to the Imaging Society of Japan are put in a polyethylene bottle having the capacity of 50 mL and are shaken at 200 rpm for five minutes with a shaker (Model YS-8D, YAYOI CO., LTD.).

The surface charge density in the electrically charged toner can be measured with an electric charge amount distribution measuring device, a specific example of which is E-spart analyzer (Hosokawa Micron Group). The E-spart analyzer is equipped with a detecting unit (measuring unit) in which an electric field and an acoustic field are both formable. The moving speed of sample particles introduced into the detecting unit is detected by the laser Doppler technique to measure the particle sizes and electric charge amount.

The method described below is employed to divide the toner into two groups of toner particles; a first group including a larger size of the toner particles, and a second group including a smaller size of the toner particles.

The toner is divided into the first group and the second group substantially equally in half in terms of particle number with an inertial classifier, Elbow-Jet (NITTETSU MINING CO., LTD.) under the following running conditions of this device; optimized feed amount and classifying edge for fine particles, and maximized classifying edge for coarse particles. When this device is thus set and run, the toner is dividable substantially equally in half, into the first group and the second group.

The setting of the running conditions of the Elbow-Jet starts with adjustment of airflow regulating valves so that an equal amount of airflow is blown to the first group and of the second group. Then, the fine particle classifying edge is adjusted in position to calculate a position at which a difference of approximately 8% is marked between the number of particles sorted into the first group and the number of particles sorted into the second group. Then, the fine particle classifying edge is fixed to the calculated position, and the airflow regulating valves for the first group and the second group are finely tuned to allow the toner particles to be divided substantially equally in half in terms of particle number, into the first group and the second group (difference between particle numbers of these groups is 4% or less). The feed amount set then may be, for example, 5 kg/hr, and a wall closer to passage of fine particles and a tip part of the fine particle classifying edge in the Elbow-Jet may be spaced apart by a distance of, for example, 10 to 15 mm.

When the toner particles are divided substantially equally in half to an extent that the difference between particle numbers of the first group and the second group is 4% or less, and the respective groups of toner particles meet the requirements defined in the present invention, satisfactory effects may be obtained. Thus, the toner particles being "divided substantially equally in half" described herein means the toner particles being divided substantially equally in half to an extent that the particle number difference is 4% or less.

The surface charge density σ ($C/m^2$) is calculated based on the electric charge amount per toner particle measured as described above for different particle sizes, specifically, calculated by the following formula;

$$\sigma = Q/\pi D^2,$$

where Q is an electric charge amount (C) per toner particle, and D is a toner particle size (m).

The absolute value σs of the average surface charge density per toner particle included in the second group may preferably be 0.038 $C/m^2$ or more.

This may allow the electric charge amount to increase in the portion of the toner with smaller particle sizes. As a result, toner particles, electric field flight of which is relatively weak, may be reduced, and the transferability and fog preventability may be further improved.

The absolute value σl of the average surface charge density per toner particle included in the first group may preferably be 0.028 $C/m^2$ or less.

This may avoid excessive increase of the electric charge amount in the portion of the toner with larger particle sizes and accordingly avoid excessive increase of the electric charge amount per unit mass of the toner. As a result, image concentration may be prevented from decreasing.

The absolute value Qs of an average electric charge amount per toner particle included in the second group may preferably be 1.4 fC or more. This may decrease toner particles each having a small electric charge amount, successfully reducing the risk of such an image defect as fog.

The absolute value Ql of an average electric charge amount per toner particle included in the first group may preferably be 2.8 fC or less. This may avoid excessive increase of the electric charge amount per unit mass of the toner, preventing undesirable decrease of image concentration.

In the toner according to the present invention, the median diameter D50 in terms of particle number may preferably be 3.0 μm or more and 6.0 μm or less, more preferably 3.0 μm or more and 5.5 μm or less, or even more preferably 3.0 μm or more and 5.0 μm or less. The D50 within these numerical ranges may allow the dot reproducibility to improve and accordingly achieve a higher image quality. The D50 of 3.0 μm or more may allow the transferability and fog preventability to improve, while the D50 of 6.0 μm or less may provide a higher image resolution. The image quality further improves with a smaller value of the D50.

The D50 may be measured by the Coulter method with a particle size distribution analyzer (trade name: Coulter Multisizer III, Beckman-Coulter Co., Ltd.).

The toner according to the present invention may preferably have a particle size distribution in which a span value expressed by the following formula (3) is 0.7 or more and 2.0 or less;

$$(D90-D10)/D50 \quad (3),$$

where D90 is a particle size on cumulative 90% in terms of particle number, and D10 is a particle size on cumulative 10% in terms of particle number.

In the toner according to the present invention, effects expected of this invention may be notably manifested with the span value of 0.7 or more, and the transferability and fog preventability may be enhanced with the span value of 2.0 or less.

The absolute value of an electric charge amount Q/M per unit mass of the toner according to the present invention may preferably be 70 μC/g or less. With the absolute value staying in this numerical range, undesirable decrease of image concentration may be successfully avoided.

The electric charge amount Q/M per unit mass of the toner according to the present invention may be calculated by the following method. In an environment at 23° C. and at 50% RH, 0.7 g of the toner and 9.3 g of a standard carrier (N-01) according to the Imaging Society of Japan are put in a polyethylene bottle having the capacity of 50 mL and are shaken at 200 rpm for five minutes with a shaker (YAYOI CO., LTD.) and thereby electrically charged by friction. Then, 0.15 g of a developer electrically charged by friction is put in a metallic container for measurement having a 635-mesh screen at its bottom, and the container is sealed with a metallic lid. The mass of the whole measurement container then is measured, which is defined as W1 (g). Subsequent to suctioning through a suction port using a suctioning device (including an insulator in at least its part that makes contact with the measurement container), an airflow regulating valve is adjusted to set the pressure of a vacuum gauge to 1.5 kPa. Then, suctioning is performed for an adequate period of time or preferably for two minutes to suction and remove the toner. The amount of electric charge stored in a capacitor at the time is defined as Q (μC). Then, the mass of the whole measurement container after the suctioning is measured, which is defined as W2 (g). The electric charge amount per unit mass (μC/g) of the toner is calculated by the following formula;

$$\text{electric charge amount per unit mass of the toner } (\mu C/g) = Q/(W1-W2).$$

To provide a greater surface charge density in the portion of the toner with smaller particle sizes than in the portion of the toner with larger particle sizes, for example, the quantity and type of an external additive to be added may be changed suitably for toner particle sizes, electric chargeability of the toner may be changed suitably for toner particle sizes, or these two methods may be combined and used.

The quantity and type of an external additive to be added may be changed suitably for particle sizes of toner particles as described below. First, two different types of toner particles that differ in average particle size are prepared. To prepare these two different types of toner particles that differ in average particle size, for example, toner particles produced beforehand may be separated by particle size with a TSP separator (Hosokawa Micron Group) into two groups of toner particles that differ in average particle size, or two types of toner particles that differ in average particle size may be independently produced. The former method may be preferable in view of production labor and cost.

Of these two types of toner particles that differ in average particle size, the toner particles smaller in average particle size are coated with an external additive having higher negative chargeability, while the toner particles larger in average particle size are coated with an external additive having lower negative chargeability. In a toner obtained by mixing these two types of toner particles thus prepared, the toner with smaller particle size may attain a relatively high surface charge density In the toner according to the present invention, preferably, the external additive may include an external additive having negative chargeability, and the external additive coating the toner included in the second group may have a higher degree of negative chargeability than the external additive coating the toner included in the first group.

When silica particles are used as the external additive, the degree of negative chargeability may be estimated from the water absorption content of silica particles obtained through evaluation of their moisture absorbency. The toner coated with silica particles having high moisture absorbency may have a correspondingly small surface resistance, in which increase of the electric charge amount may be difficult. The toner coated with silica particles having low moisture absorbency, on the other hand, may have a correspondingly large surface resistance and may be allowed to increase its electric charge amount.

Examples of the silica particles may include fumed silica particles and sol-gel silica particles. The fumed silica particles have low water absorption and accordingly exhibit high negative chargeability, whereas the sol-gel silica particles have high water absorption and accordingly exhibit low negative chargeability The water absorption content of silica particles obtained through evaluation of their moisture absorbency may be measured with a heat quantity measuring device (trade name: Q5000SA, TA Instruments), as described below.

Approximately 20 mg of silica particles is put on a sample tray of the device and starts to be measured after the device is so programmed that the internal environment of a chamber is kept is set to and kept at 23° C. and at 50% RH for 24 hours and then kept at 40° C. and at 95% RH for one hour. The water absorption content is defined σs (TGA2−TGA1)/TGA1, where TGA1 is a mass measured in 24 hours after the measurement starts, and TGA2 is a mass measured one hour later at 40° C. and at 95% RH.

In high-absorbency silica particles, the water absorption content thus measured and calculated may preferably be 1.0% or more, a specific example of which is fumed silica.

In low-absorbency silica particles, the water absorption content thus measured and calculated may preferably be 0.5% or less, a specific example of which is sol-gel silica.

To change the type of an external additive to be used according to the toner particle sizes, for example, the coating ratio of an external additive having negative chargeability used then may be increased for toner particles smaller in average particle size, and decreased for toner particles larger in average particle size. In a toner obtained by mixing these two types of toner particles thus prepared, the toner with smaller particle size may attain a relatively high surface charge density.

In the toner according to the present invention, preferably, the external additive may include an external additive having negative chargeability, and values of Cs and Cl satisfy the relationship expressed by the following formula (4);

$$0.10 \leq Cl/Cs \leq 0.80 \quad (4),$$

where the Cs is a coating ratio of the toner included in the second group with the external additive having negative chargeability, and the Cl is a coating ratio of the toner included in the first group with the external additive having negative chargeability.

In view of the transferability and fog preventability, the Cs and Cl may preferably satisfy the relationship expressed by the following formula (5);

$$0.10 \leq Cl/Cs \leq 0.67 \quad (5).$$

To change electric chargeability of the toner according to particle sizes, any suitable method may be employed insofar as the method allows the toner to have different surface charge densities in its two portions. For example, a charge control agent that imparts chargeability may be added in different amounts to the portion of the toner with larger particle sizes and to the portion of the toner with smaller particle sizes to allow the toner particles that thus differ in particle size to have different surface charge densities. In the toner according to the present invention, values of CAs and CAl may preferably satisfy the relationship expressed by the following formula (6);

$$0.10 \leq CAl/CAs \leq 0.80 \quad (6),$$

where the CAs is the content of the charge control agent in the toner included in the second group, and the CAl is the content of the charge control agent in the toner included in the first group.

In view of the transferability and fog preventability, the CAs and CAl may preferably satisfy the relationship expressed by the following formula (7);

$$0.10 \leq CAl/CAs \leq 0.50 \quad (7).$$

While the charge control agent may be selected from the known agents, such a charge control agent may be preferable that excels in charging speed and stably keeps a constant amount of electric charge. In case the toner particles are directly produced by polymerization, a charge control agent used then may preferably have low polymerization-inhibitory properties and contain substantially no material soluble in aqueous media.

Examples of the charge control agent that imparts negative chargeability to the toner particles may include: organic metal compounds and chelate compounds including monoazo metal compounds, acetylacetone metal compounds, aromatic oxycarboxylic acid-based metal compounds, aromatic dicarboxylic acid-based metal compounds, oxycarboxylic acid-based metal compounds, and dicarboxylic-based metal compounds; aromatic dicarboxylic acids, aromatic mono- and poly-carboxylic acids and metal salts thereof; anhydrides; esters; phenol derivatives including bisphenol; urea derivatives; metal-containing, salicylic acid-based compounds; metal-containing, naphthoic acid-based compounds; boron compounds; quaternary ammonium salts; and calixarenes.

Examples of the charge control agent that imparts positive chargeability to the toner particles may include: nigrosine-modified products including nigrosine and fatty acid metal salts; guanidine compounds; imidazole compounds; quaternary ammonium salts including tributylbenzyl ammonium-1-hydroxy-4-naphthosulfonate and tetrabutylammonium tetrafluoroborate, and their analogues including onium salts such as phosphonium salt and lake pigments thereof; triphenylmethane dyes and lake pigments thereof (examples of laking agents may include phosphotungstic acid, phosphomolybdic acid, phosphotungstic-phosphomolybdic acid, tannic acid, lauric acid, gallic acids, ferricyanides, and ferrocyanides); metal salts of higher fatty acids; and resin-based charge control agents.

Any one of these examples of the charge control agent may be singly used, or two or more of them may be combined and used. Among these examples, metal-containing, salicylic acid-based compounds in which the metal is aluminum or zirconium may be particularly preferable. The most desirable charge control agent may be 3,5-di-tert-butylsalicylic acid aluminum compound.

<Binding Resin>

The toner particles of the present invention may contain a binding resin selected from the following polymers: monopolymers of styrene and substitution products thereof including polystyrene, poly-p-chlorostyrene, and polyvinyl toluene; styrene-based copolymers including styrene-p-chlorostyrene copolymers, styrene-vinyl toluene copolymers, styrene-vinyl naphthalene copolymers, styrene-acrylic acid ester copolymers, and styrene-methacrylic acid ester copolymers; polyvinyl chloride; phenolic resin; natural resin-modified phenolic resin; natural resin-modified maleic resins acrylic resin; methacrylic resins; polyvinyl acetate, silicone resins; polyester; polyurethane; polyamide; furan resin; epoxy resin; xylene resin; polyethylene; and polypropylene. Preferably, the binding resin used in the present invention may consist primarily of polyester in view of fixability at low temperatures.

Monomers used in the polyester unit of polyester include multivalent alcohol (bivalent, trivalent, or more than trivalent alcohol), multivalent carboxylic acid (bivalent, trivalent, or more than trivalent carboxylic acid), and an acid anhydride or lower alkyl ester thereof. Notably, partial crosslinking in a molecule of a non-crystalline resin may be effective for production of a branched polymer to allow "strain-hardening properties" to be expressed. To serve this purpose, a trivalent or more than trivalent multifunctional compound may preferably be used. The monomer; material of polyester unit, may preferably include trivalent or more than trivalent carboxylic acid, an acid anhydride or lower alkyl ester thereof, and/or trivalent or more than trivalent alcohol.

Examples of the multivalent alcohol monomer used in the polyester unit of polyester are listed below.

Examples of the bivalent alcohol may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, bisphenol hydride A, bisphenol expressed by the following formula (A) and a derivative thereof, and diols expressed by the following formula (B).

(A)

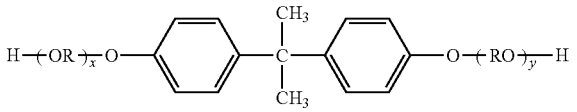

(in the formula (A), R is an ethylene group or a propylene group, x and y are integral numbers of 0 or more, and an average value of x+y is 0 or more and 10 or less).

(B)

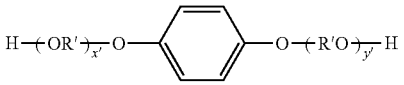

(in the formula (B), R' is —$CH_2CH_2$—, —$CH_2CH(CH_3)$—, or —$CH_2C(CH_3)_2$—, x' and y' are integral numbers of 0 or more, and an average value of x'+y' is 0 or more and 10 or less).

Examples of the trivalent or more than trivalent alcohol may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene. Of these examples, glycerol, trimethylolpropane, or pentaerythritol may preferably be used. One selected from these bivalent, trivalent, or more than trivalent alcohols may be singly used, or two or more of them may be combined and used.

Examples of the multivalent carboxylic acid monomer used in the polyester unit of polyester are listed below.

Examples of the bivalent carboxylic acid may include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenylsuccinic acid, n-dodecyl succinic acid, isododecylsuccinic acid, n-octenylsuccinic acid, n-octylsuccinic acid, isooctenylsuccinic acid, isooctylsuccinic acid, and acid anhydrides and lower alkyl esters thereof. Of these examples, maleic acid, fumaric acid, terephthalic acid, or n-dodecenylsuccinic acid may preferably be used.

Examples of the trivalent or more than trivalent carboxylic acid and acid anhydride or lower alkyl ester thereof may include 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxylpropane, 1,2,4-cyclohexane tricarboxylic acid, tetra(methylene carboxyl) methane, 1,2,7,8-octane tetracarboxylic acid, pyromellitic acid, empol trimer acid, and anhydrides and lower alkyl esters thereof. Of these examples, 1,2,4-benzene tricarboxylic acid, i.e., trimellitic acid or a derivative thereof may preferably be used because of its inexpensiveness and easier reaction control. One selected from these bivalent, trivalent, or more than trivalent carboxylic acids may be singly used, or two or more of them may be combined and used.

Any available known method may be chosen and used to produce polyester. For example, polyester may be produced by preparing at once an alcohol monomer and a carboxylic acid monomer as described earlier, and then polymerizing these monomers through esterification, transesterification, and condensation reaction. The temperature of polymerization then is not particularly limited, however, may preferably be 180° C. or more and 290° C. or less. The polymerization of polyester may be mediated by a polymerization catalyst, examples of which may include titanium-based catalysts, tin-based catalysts, zinc acetate, antimony trioxide, and germanium dioxide. When the binding resin used is a non-crystalline resin, the non-crystalline resin may preferably be polyester polymerized with a tin-based catalyst.

The acid value of polyester may preferably be 5 mgKOH/g or more and 20 mgKOH/g or less, and the hydroxyl value of polyester may preferably be 20 mgKOH/g or more and 70 mgKOH/g or less, because the water absorption content may be controllable in high-temperature, high-humidity environments, which leads to lower non-electrostatic adhesion and accordingly conduces to fog preventability.

When the binding resin used is a non-crystalline resin, the non-crystalline resin may be a combination of a low-molecular resin and a high-molecular resin. The content of the high-molecular resin relative to the low-molecular resin may preferably be 40/60 to 85/15 in terms of mass from the aspects of low-temperature fixability and hot-offset resistance.

<Release Agent>

Examples of a wax used as release agent in the toner may include: hydrocarbon-based waxes including low-molecular polyethylene, low-molecular polypropylene, alkylene copolymers, microcrystalline waxes, paraffin waxes, Fischer-Tropsch waxes; oxides of hydrocarbon-based waxes including polyethylene oxide waxes or block copolymers thereof;

waxes consisting primarily of fatty acid esters including carnauba waxes; products obtained by deoxidizing in part or in whole of fatty acid esters including deoxidized carnauba waxes; saturated straight-chained fatty acids including palmitic acid; stearic acid, and montanic acid; unsaturated fatty acids including brassidic acid, eleostearic acid, and parinaric acid; saturated alcohols including stearyl alcohol, aralkyl alcohol, behenyl alcohol, carnaubil alcohol, ceryl alcohol, and melissyl alcohol; multivalent alcohols including sorbitol; esters of fatty acids including palmitic acid, stearic acid, behenic acid, and montanic acid and alcohols including stearyl alcohol, aralkyl alcohol, behenyl alcohol, carnaubil alcohol, ceryl alcohol, and melissyl alcohol; fatty acid amides including amide linoleate, amide oleate, and amide laurate; saturated fatty acid bisamides including methylene bisstearamide, ethylene biscapramide, ethylene bislauramide, and hexamethylene bisstearamide; unsaturated fatty acid amides including ethylene bisoleamide, hexamethylene bisoleamide, N,N'-dioleyl adipamide, and N,N'-dioleyl sebacamide; aromatic bisamides including m-xylene bisstearamide, and N,N'-distearyl isophthalamide; fatty acid metal salts including calcium stearate, calcium laurate, zinc stearate, and magnesium stearate (generally called as metallic soap); waxes produced by grafting aliphatic hydrocarbon-based waxes using vinyl-based monomers including styrene and acrylic acid; partially esterified products of multivalent alcohols and fatty acids including behenic acid; and hydroxyl group-containing methylesterified products produced by adding hydrogen to vegetable oils.

Of these exemplified waxes, hydrocarbon-based waxes including paraffin waxes and Fischer-Tropsch waxes, and fatty acid ester-based waxes including carnauba waxes may be preferably used for better low-temperature fixability and separability. In the present invention, the hydrocarbon-based waxes may be particularly preferable candidates in favor of hot-offset resistance.

The wax content in the present invention may preferably be 3 parts by mass or more and 8 parts by mass or less in 100 parts by mass of the binding resin.

In an endothermic curve during temperature rise measured with a differential scanning calorimeter (DSC), a peak temperature at a largest endothermic peak of the wax may preferably be 45° C. or more and 140° C. or less. By setting this peak temperature to stay within the range of degrees, desirable storage stability and hot-offset resistance of the toner may be both successfully achieved.

<Colorant>

The toner particles according to the present invention may contain a colorant. Examples of the colorant may include the following materials.

The toner may include a black colorant, which is prepared by mixing, for example, carbon black with a yellow colorant, a magenta colorant, and a cyan colorant. While the colorant may solely consist of a pigment, a dye and a pigment may preferably be combined and used for better clarity to allow full-color images to improve in image quality.

Examples of pigments for magenta toner may include: C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C.I. pigment violet 19; and C.I. bat red 1, 2, 10, 13, 15, 23, 29, and 35.

Examples of dyes for magenta toner may include: C.I. solvent red 1, 3, 8, 23, 24, 25, 27, 30, 49, 81, 82, 83, 84, 100, 109, 121; C.I. disperse red 9; C.I. solvent violet 8, 13, 14, 21, 27; oil-soluble dyes like C.I. disperse violet 1; C.I. basic red 1, 2, 9, 12, 13, 14, 15, 17, 18, 22, 23, 24, 27, 29, 32, 34, 35, 36, 37, 38, 39, 40; and basic dyes like C.I. basic violet 1, 3, 7, 10, 14, 15, 21, 25, 26, 27, 28.

Examples of pigments for cyan toner may include: C.I. pigment blue 2, 3, 15:2, 15:3, 15:4, 16, 17; C.I. bat blue 6; C.I. acid blue 45; and copper phthalocyanine pigments substituted with 1 to 5 phthalimide methyl groups in phthalocyanine skeleton.

Examples of dyes for cyan toner may include C.I. solvent blue 70.

Examples of pigments for yellow toner may include: C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; and C.I. bat yellow 1, 3, 20.

Examples of dyes for yellow toner may include C.I. solvent yellow 162.

Among these colorants, any one of them may be singly used, or two or more of them may be combined and used. The colorant(s) may be used in the form of solid solution. The colorant(s) may be selected and used in light of hue angle, chrominance, lightness, light resistance, OHP transparency, and dispersibility in the toner.

The content of the colorant(s) may preferably be 0.1 part by mass or more and 30.0 parts by mass or less in the whole resin component.

<Inorganic Particles>

The toner, if necessary, may include two different types of silica particles or may include any other inorganic fine particles instead of silica fine particles.

The inorganic fine particles may be used as an original component of the toner particles or may be added later to the toner particles as external additive.

Preferable examples of the external additive may include inorganic fine particles including silica particles, titanium oxide particles, aluminum oxide particles, and strontium titanate particles. Of these examples, external additives having low resistances, such as titanium oxide particles and strontium titanate particles, may be particularly preferable in view of the transferability and fog preventability because of the following advantages; control of possible changes in electric charge amount in high-temperature, high-humidity environments, control of localization of electric charges in the toner, and reduced electrostatic adhesion. The inorganic fine particles may preferably be hydrophobized with a hydrophobizing agent, for example, a silane compound, silicone oil, or a mixture thereof.

The external additive added to improve flowability may preferably be inorganic fine particles having a specific surface area of 50 $m^2/g$ or more and 400 $m^2/g$ or less.

The external additive may be mixed with the toner particles with a known mixer, for example, Henschel mixer.

<Developer>

While the toner may be used as a one-component developer, the toner may be mixed with a magnetic carrier and used as a two-component developer in order to further improve the dot reproducibility and offer images stable in quality over an extended period of time The magnetic carrier may be selected from the known materials, examples of which may include: iron oxide; metal particles including iron, lithium, calcium, magnesium, nickel, copper, zinc, cobalt, manganese, chrome, and rare earths, alloy particles thereof, and oxide particles thereof;

magnetic materials including ferrite; and magnetic material-containing resin carriers further containing binder resins in which the magnetic materials are dispersedly present (conventionally referred to as resin carrier).

When the toner is mixed with a magnetic carrier and used as a two-component developer, the content of the toner in the two-component developer may preferably be 2 mass % or more and 15 mass % or less, or more preferably 4 mass % or more and 13 mass % or less.

<Toner Production Method>

A method for production of the toner particles, though not necessarily particularly limited, may preferably be pulverizing in view of components' dispersibility.

Steps of the toner production by pulverizing are hereinafter described.

A material mixing step is a step of weighing and mixing predetermined amounts of materials constituting the toner particles, for example, the binding resin, release agent, colorant, crystalline polyester, and other components, if necessary, such as charge control agent. A mixer used then may be selected from, for example, double concrete mixer, V-type mixer, drum mixer, super mixer, Henschel mixer, Nauta mixer, and Mechano Hybrid (NIPPON COKE & ENGINEERING CO., LTD.).

Next, a melting and kneading step is performed to melt and knead the mixed materials for wax dispersion in the binding resin, in which any one of the following devices may be used; pressure kneader, batch-type kneader like Banbury mixer, and continuous kneader. Use of a uniaxial or biaxial extruder may be advantageous for continuous production. Examples of the uniaxial or biaxial extruder may include KTK biaxial extruder (Kobe Steel, Ltd.), TEM biaxial extruder (TOSHIBA MACHINE CO., LTD.), PCM kneader (Ikegai Corp.), biaxial extruder (TOSEI ENGINEERING), Co-Kneader (Buss AG), and KNEADEX (NIPPON COKE & ENGINEERING CO., LTD.). A resin composition obtained by melting and kneading the materials may be rolled under pressure with a two-roll mill and then cooled with water in a cooling step that follows.

The cooled resin composition is then pulverized in a pulverizing step into desired particle sizes. The pulverizing step, first, pulverizes the resin composition into coarse particles using a pulverizer, for example, a crusher, hammer mill, or feather mill, and then pulverizes the coarse particles into finer toner particles using, for example, Kriptron system (Kawasaki Heavy Industries, Ltd.), super rotor (Nisshin Engineering Inc.), turbo mill (TURBO KOGYO), or an air-jet pulverizer.

If necessary, the obtained toner particles may be classified with a classifier or a screen classifier. Examples of the classifier and screen classifier may include an inertial classifier, Elbow-Jet (NITTETSU MINING CO., LTD.), Turboplex (Hosokawa Micron Group), TSP separator (Hosokawa Micron Group), and Faculty (Hosokawa Micron Group).

Optionally, the toner particles may be heated for surface treatment to attain a higher degree of circularity of the toner. The surface treatment may be performed by exposing the toner particles to hot air using, for example, a thermal spheronizing device illustrated in FIGURE.

The mixture quantitatively determined by a material weight or volumetric or counting feeder 1 is guided by compressed air adjusted by a compressed air flow rate adjuster 2 and introduced into a guiding tube 3 disposed on a vertical line of the material feeder 1. The mixture passing through the guiding tube 3 is evenly dispersed by a conical protruding member 4 disposed at the center of the material feeder 1 and is guided into feeding tubes 5 radially extending in eight directions, and then, further into a treatment chamber 6 where heat treatment is performed.

The flow of the mixture that arrived at the treatment chamber 6 is regulated by a regulator 9 disposed inside the chamber 6 to regulate fluid flow. The mixture in the treatment chamber 6, therefore, is heated while swirling in the treatment chamber 6 and then cooled.

The hot air used for heat treatment of the mixture is supplied from a hot air feeder 7 and evenly distributed by a distributing member 12, and is then guided toward an outlet 11 of the hot air feeder 7 and spirally swirled into the treatment chamber 6 by a swirling member 13. The swirling member 13 disposed to swirl hot air includes a plurality of blades, and the swirling flow of hot air is adjustable in accordance with the number and angle(s) of the blades. The hot air guided into the treatment chamber 6 may preferably have a temperature of 100° C. or more and 300° C. or less at the time of passing through the outlet of the hot air feeder 7. The hot air at a temperature in this range of degrees may provide the toner particles equally shaped in spherical form without melting and/or coalescing the toner particles by overheating.

Subsequent to the heat treatment, the toner particles are cooled with cold air flow from a cold air feeder 8 (cold air feeders 8-1, 8-2, and 8-3). The cold air from the cold air feeder 8 may preferably have a temperature of −20° C. or more and 30° C. or less. The cold air at a temperature in this range of degrees may efficiently cool the toner particles. This may prevent the toner particles from melting and/or coalescing without obstructing the process to equally spheronize the toner particles. The absolute water content of the cold air may preferably be 0.5 g/m$^3$ or more and 15.0 g/m$^3$ or less.

The toner particles thus heated and then cooled are collected by a collector 10 disposed at a lower end of the treatment chamber 6. The collector 10 has a blower (not illustrated in the drawing) at its edge, which serves to suction and transport the toner particles.

Particle feeding ports 14 are so situated that swirling flows of the mixture and of the hot air are guided in the same direction. The collector 10 of the spheronizing device is disposed on an outer peripheral part of the treatment chamber 6 to allow the direction of the swirling particles to remain unchanged. The cold air from the cold air feeder 8 is guided to flow horizontally and tangentially in a direction from the outer peripheral part of the device toward the inner peripheral surface of the treatment chamber. In the treatment chamber 6, turbulent flow may be unlikely to occur, because swirling flows of the toner particles from the particle feeding ports 14, of the cold air from the cold air feeder, and of the hot air from the hot air feeder 7 are all equally directed and are accordingly swift and powerful inside the device. Such swirling flows may apply an intense centrifugal force to the toner particles and allow the toner particles to be more dispersible. The toner particles finally obtained, therefore, may be equally shaped with a reduced number of coalesced particles.

The average degree of circularity of the toner particles may preferably be 0.960 or more and 0.980 or less. This may reduce non-electrostatic adhesion, thereby improving the fog preventability.

The inertial classifier, Elbow-Jet (NITTETSU MINING CO., LTD.), may be used to divide the heated toner particles by particle size into the first group and the second group. After the toner particles are divided by particle size, a desired amount of silica fine particles are externally added to surfaces of the toner particles by, for example, stirring and mixing using a mixer. Examples of the mixer used then may include double concrete mixer, V-type mixer, drum mixer, super mixer, Henschel mixer, Nauta mixer, and Mechano Hybrid (NIPPON COKE & ENGINEERING CO., LTD.), and Notilta (Hosokawa Micron Group). Any other suitable external additive, such as a plasticizing agent, may be used instead of the silica fine particles.

Measurements of physical properties of the toner and materials are described in the following specific examples.

<Method for Measurement of Average Circularity of Toner Particles>

The average degree of circularity of the toner particles is measured with a flow particle imaging analyzer, "FPIA-3000" (Sysmex Corporation) under conditions of measurement and analysis for calibration. The principle of measurement of this flow particle imaging analyzer, "FPIA-3000" (Sysmex Corporation) is that flowing particles are captured as static images and subjected to image analysis. A sample introduced into a sample chamber is guided into a flat sheath flow cell by a sample suctioning syringe. The sample flow in the flat sheath flow cell is flat between flows of a sheath fluid. The sample passing through the flat sheath flow cell is irradiated with strobo light at intervals of 1/60 second. Thus, the flowing particles are captured as static images, and the sample's flat flow allows well-focused images to be captured. Particle images are captured with a CCD camera, and the captured images are image-processed with a resolution of 512×512 pixels (0.37×0.37 μm per pixel). Then, contours of the particle images are extracted, and projected areas S and perimeters L of the obtained images are measured.

Next, equivalent circle diameters and degrees of circularity are calculated based on the projected areas S and perimeters L. The equivalent circle diameter means the diameter of a circle equal in area dimension to the projected area of each particle image. The degree of circularity C is defined as a value of the perimeter of a circle calculated from the equivalent circle diameter and divided by the perimeter of the particle image. The degree of circularity C is calculated by the following formula; $C=2\times(\pi\times s)^{1/2}/L$.

In case the particle image is circular, the degree of circularity is 1.00. The particle image has a smaller degree of circularity with more irregularities on its outer periphery. The degrees of circularity of particles are calculated, and an arithmetic average value of the degrees of circularity is calculated and used as an average degree of circularity.

The method for measurement is described in detail below.

First, 20 mL of ion-exchanged water, from which solid impurity has been removed beforehand, is put in a glass container. A diluted solution is prepared by 3-fold dilution by mass of "Contaminon N"; dispersant, with ion-exchanged water ("Contaminon N" is a pH 7, 10 mass % aqueous solution of a neutral detergent for precision measurement equipment that contains a non-ion surfactant, a negative ion surfactant, and an organic builder, Wako Pure Chemicals Ltd.). Approximately 0.2 mL of this diluted solution and approximately 0.02 g of a measurement sample are added to the diluted solution in the container and are dispersed with an ultrasonic disperser for two minutes. The resulting solution is used as a dispersing fluid for measurement. The dispersing fluid is cooled to reach a temperature of 10° C. or more and 40° C. or less. The ultrasonic disperser used then is a desktop ultrasonic cleaner having the oscillation frequency of 50 kHz and 150 W electric output ("VS-150", VELVO-CLEAR). A predetermined amount of ion-exchanged water is put in a water tank, to which approximately 2 mL of Contaminon N is added.

A device used for the measurement is a flow particle image analyzer equipped with a standard object lens (10-fold magnification), and the sheath fluid is Particle sheath, "PSE-900A" (Sysmex Corporation). The dispersing fluid prepared as described is introduced into the flow particle image analyzer, and 3,000 toner particles were measured under the conditions of HPF measurement mode and total count mode.

A binary threshold for particle analysis is set to 85%, and particle sizes to be analyzed are set to equivalent circle diameters of 1.98 μm or more and 39.96 μm or less. Then, the toner's average degree of circularity is calculated.

Before the measurement starts, the device is subjected to automatic focus adjustment using standard latex particles. The standard latex particles used then are, for example, RESEARCH AND TEST PARTICLES Latex Microsphere Suspensions 5200A (Duke Scientific Corporation) diluted with ion-exchanged water. The automatic focus adjustment may preferably be performed at regular intervals of two hours after the measurement starts.

<Surface Compositional Analysis Using X-Ray Photoelectron Spectroscopic Analysis (ESCA)>

In the present invention, the coating ratio of toner particle surfaces with the external additive can be calculated through surface compositional analysis using X-ray photoelectron spectroscopic analysis (ESCA). The following device and conditions for measurement are used in the ESCA.

Device: PHI5000 VersaProbell Scanning XPS Microprobe (Physical Electronics Industries, INC.)

Conditions: X-ray source AlKα (100μ, 25 W, 15 KV)

Angle: 45°

Pass Energy: 58.70 eV

EXAMPLES

The present invention is hereinafter described in further detail using working examples and comparative examples. The present invention, however, is not necessarily limited to the examples below. Any parts and percentages described in the working examples and comparative examples represent values by mass unless specified otherwise.

<Example of Production: Non-Crystalline Resin 1>

- Polyoxypropylene(2.2)-2,2-bis(4-hydroxyphenyl)propane: 73.8 parts by mass (0.19 mol, 100.0 mol % to the total molar number of multivalent alcohol)
- Terephthalic acid: 12.5 parts by mass (0.08 mol, 48.0 mol % to the total molar number of multivalent carboxylic acid)
- Adipic acid: 7.8 parts by mass (0.05 mol, 34.0 mol % to the total molar number of multivalent carboxylic acid)
- Titanium tetrabutoxide (esterified catalyst): 0.5 part by mass These materials were weighed and put in a reaction tank equipped with a cooling tube, stirrer, nitrogen introducing tube, and thermocouple. After gas in a flask was substituted with nitrogen gas, the mixture of these materials was stirred and heated slowly to higher temperatures and reacted, while being stirred, at 200° C. for two hours.

The internal pressure of the reaction tank was lowered to 8.3 kPa and maintained at the pressure for one hour and then back to the atmospheric pressure by cooling to 160° C. (first reaction step).

- Trimellitic acid: 5.9 parts by mass (0.03 mol, 18.0 mol % to the total molar number of multivalent carboxylic acid)
- Tert-butylcatechol (polymerization inhibitor): 0.1 part by mass These materials were added to the reaction tank, the internal pressure of which was then dropped to 8.3 kPa, and the materials were reacted at 200° C. for 15 hours. The temperature was lowered to arrest the reaction when the softening point measured according to ASTM 36-86 was determined to be 120° C. (second reaction step). As a result, a non-crystalline resin 1 was obtained. In the obtained non-crystalline resin 1, its peak molecular weight was MP10,000, softening point Tm was 110° C., and glass transition temperature Tg was 60° C.

<Example of Production: Toner 1>

<Example of Production: F Toner 1 (a Second Group>

Non-crystalline resin 1: 100 parts

Fischer-Tropsch wax (peak temperature of 90° C. at a highest endothermic peak): 4 parts Polymer in which a styrene acrylic polymer is graft-polymerized to a polyolefin: 14 parts Charge control agent: 3,5-di-t-butylsalicylic acid aluminum compound (BONTRON E88, Orient Chemical Industries Co., Ltd.): 0.3 part by mass Carbon black: 10 parts These materials were mixed with a Henschel mixer (FM-75, Mitsui Mining Co., Ltd.) set to rotate at 1,500 rpm for five minutes, and then kneaded with a biaxial kneader (PCM-30, Ikegai Corp.) with temperature setting of 130° C. The obtained kneaded matter was cooled and crushed with a hammer mill into coarse particles of 1 mm or less. The obtained particles were pulverized into finer particles with a mechanical pulverizer (T-250, TURBO KOGYO). The resulting fine particles were classified with Faculty (F-300, Hosokawa Micron Group), and toner particles 1 were obtained. The running conditions of the device, Faculty, were; classifying rotor rotated at 11,000 rpm, and dispersing rotor rotated at 7,200 rpm.

The obtained toner particles 1 were subjected to heat treatment using a thermal spheronizing device shown in FIGURE to obtain thermally treated toner particles 1. The running conditions of the thermal spheronizing device were; feed of 5 kg/hr, hot air temperature C of 160° C., hot air flow rate of 6 $m^3$/min., cold air temperature E of −5° C., cold air flow rate of 4 $m^3$/min. blower flow rate of 20 $m^3$/min., and injection air flow rate of 1 $m^3$/min.

The thermally treated toner particles 1 were divided by particle size with an inertial classifier, Elbow-Jet (NITTETSU MINING CO., LTD.), into toner particles with larger particle sizes and toner particles with smaller particle sizes. The running conditions of the Elbow-Jet were; feed of 5 kg/hr, F-classifying edge (fine particle classifying edge) of 10 mm to 15 mm, and max G-classifying edge (coarse particle classifying edge), so that the thermally treated toner particles 1 were equally divided into two groups of particles.

Thermally treated toner particles 1 with smaller particle sizes: 100 parts

Fumed silica surface-treated with hexamethyldisilazane (median diameter (D50) in terms of particle number: 40 nm): 4.0 parts Titanium oxide fine particles surface-treated with isobutyl trimethoxysilane (median diameter (D50) in terms of particle number: 10 nm): 1.0 parts These materials were mixed with a Henschel mixer (FM-75, Mitsui Miike Co., Ltd.) set to rotate at 1,900 rpm for 10 minutes to obtain an F toner 1 (a second group).

<Example of Production: M Toner 1 (a First Group)>

Thermally treated toner particles 1 with larger particle sizes: 100 parts

Sol-gel silica surface-treated with hexamethyldisilazane (median diameter (D50) in terms of particle number: 40 nm): 4.0 parts Titanium oxide fine particles surface-treated with isobutyl trimethoxysilane (median diameter (D50) in terms of particle number: 10 nm): 1.0 parts These materials were mixed with a Henschel mixer (FM-75, Mitsui Miike Co., Ltd.) set to rotate at 1,900 rpm for 10 minutes to obtain an M toner 1 (a first group)

The obtained F toners 1 and M toners 1 were evenly mixed to obtain a toner 1. Table 4 shows physical properties of the toner 1 measured by the method described earlier.

<Examples of Production: Toners 2 to 16>

In other examples of production of the toner 1, F toners 2 to 16 and M toners 2 to 16 were similarly produced, except changes of the components and conditions shown in Tables 1 and 2.

Then, the F toners 2 to 16 and the M toners 2 to 16 were combined as shown in Table 3 to obtain toners 2 to 16. Table 4 shows physical properties of the toners 2 to 16.

TABLE 1

| | Original components | | | | External additive | | |
|---|---|---|---|---|---|---|---|
| | | Method of production | | | | | |
| | Composition | Mechanical pulverizer: | Titanium oxide fine particles | | Silica fine particles | | |
| F Toner | Charge control agent Part | running conditions Rotor: rotated at [rpm] | Particle size [nm] | Part | Method of production | Particle size [nm] | Part |
| 1 | 0.3 | 10000 | 10 | 1.0 | Dry | 40 | 4.0 |
| 2 | 0.3 | 10000 | 10 | 1.0 | Dry | 40 | 6.0 |
| 3 | 1.0 | 10000 | 10 | 1.0 | Dry | 40 | 3.0 |
| 4 | 0.3 | 10000 | 10 | 1.0 | Dry | 40 | 3.3 |
| 5 | 0.3 | 10000 | 10 | 1.0 | Dry | 40 | 5.0 |
| 6 | 1.0 | 10000 | 10 | 1.0 | Dry | 40 | 3.0 |
| 7 | 0.3 | 10000 | 10 | 1.0 | Dry | 40 | 6.0 |
| 8 | 0.3 | 10000 | 10 | 1.0 | Dry | 40 | 4.0 |
| 9 | 0.3 | 10000 | 10 | 1.0 | Dry | 40 | 3.0 |
| 10 | 0.5 | 10000 | 10 | 1.0 | Dry | 40 | 3.0 |
| 11 | 0.3 | 12000 | 10 | 1.0 | Dry | 40 | 6.0 |
| 12 | 0.3 | 9000 | 10 | 1.0 | Dry | 40 | 3.0 |
| 13 | 0.3 | 10000 | 10 | 1.0 | Dry | 40 | 4.0 |
| 14 | 0.3 | 10000 | 10 | 1.0 | Wet | 40 | 4.0 |

TABLE 1-continued

| | Original components | | | | External additive | | |
|---|---|---|---|---|---|---|---|
| | Composition | Method of production Mechanical pulverizer: | Titanium oxide fine particles | | Silica fine particles | | |
| F Toner | Charge control agent Part | running conditions Rotor: rotated at [rpm] | Particle size [nm] | Part | Method of production | Particle size [nm] | Part |
| 15 | 0.3 | 10000 | 10 | 1.0 | Dry | 40 | 3.0 |
| 16 | 0.3 | 10000 | 10 | 1.0 | Dry | 40 | 6.5 |

TABLE 2

| | Original components | | | | External additive | | |
|---|---|---|---|---|---|---|---|
| | Composition | Method of production Mechanical pulverizer: | Titanium oxide fine particles | | Silica fine particles | | |
| M Toner | Charge control agent Part | running conditions Rotor: rotated at [rpm] | Particle size [nm] | Part | Method of production | Particle size [nm] | Part |
| 1 | 0.3 | 10000 | 10 | 1.0 | Wet | 40 | 4.0 |
| 2 | 0.3 | 10000 | 10 | 1.0 | Dry | 40 | 3.0 |
| 3 | 0.3 | 10000 | 10 | 1.0 | Dry | 40 | 3.0 |
| 4 | 0.3 | 10000 | 10 | 1.0 | Wet | 40 | 3.3 |
| 5 | 0.3 | 10000 | 10 | 1.0 | Dry | 40 | 2.5 |
| 6 | 0.3 | 10000 | 10 | 1.0 | Dry | 40 | 3.0 |
| 7 | 0.3 | 10000 | 10 | 1.0 | Dry | 40 | 4.5 |
| 8 | 0.3 | 10000 | 10 | 1.0 | Dry | 40 | 3.0 |
| 9 | 0.3 | 10000 | 10 | 1.0 | Wet | 40 | 3.0 |
| 10 | 0.3 | 10000 | 10 | 1.0 | Dry | 40 | 3.0 |
| 11 | 0.3 | 12000 | 10 | 1.0 | Wet | 40 | 6.0 |
| 12 | 0.3 | 9000 | 10 | 1.0 | Wet | 40 | 3.0 |
| 13 | 0.3 | 10000 | 10 | 1.0 | Dry | 40 | 4.0 |
| 14 | 0.3 | 10000 | 10 | 1.0 | Dry | 40 | 4.0 |
| 15 | 0.3 | 10000 | 10 | 1.0 | Dry | 40 | 5.0 |
| 16 | 0.3 | 10000 | 10 | 1.0 | Dry | 40 | 6.5 |

The "dry type", "wet type", and "titanium oxide fine particles" in Table 1 and Table 2 are respectively as follows.

Dry type: fumed silica surface-treated with hexamethyldisilazane

Wet type: Sol-gel silica surface-treated with hexamethyldisilazane

Titanium oxide fine particles: surface-treated with isobutyl trimethoxysilane

TABLE 3

| Toner | F toner | M toner |
|---|---|---|
| 1 | 1 | 1 |
| 2 | 2 | 2 |
| 3 | 3 | 3 |

TABLE 3-continued

| Toner | F toner | M toner |
|---|---|---|
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |
| 11 | 11 | 11 |
| 12 | 12 | 12 |
| 13 | 13 | 13 |
| 14 | 14 | 14 |
| 15 | 15 | 15 |
| 16 | 16 | 16 |

TABLE 4

| Toner | Median diameter [μm] | Span value | Degree of circularity | σs [C/m$^2$] | σl [C/m$^2$] | σl/σs [—] | Qs [fC] | Ql [fC] | Q/M [μC/g] | Cs [%] | Cl [%] | Cl/Cs [—] | CAl/CAs [—] |
|---|---|---|---|---|---|---|---|---|---|---|---|---|---|
| 1 | 4.5 | 0.8 | 0.968 | 0.038 | 0.021 | 0.55 | 1.6 | 2.1 | 32.1 | 61% | 61% | 1.00 | 1.00 |
| 2 | 4.5 | 0.8 | 0.968 | 0.041 | 0.026 | 0.63 | 1.7 | 2.6 | 38.9 | 92% | 46% | 0.50 | 1.00 |
| 3 | 4.5 | 0.8 | 0.968 | 0.043 | 0.026 | 0.60 | 1.8 | 2.5 | 38.9 | 46% | 46% | 1.00 | 0.30 |
| 4 | 5.5 | 0.8 | 0.967 | 0.038 | 0.018 | 0.47 | 1.9 | 2.5 | 21.5 | 62% | 62% | 1.00 | 1.00 |
| 5 | 5.5 | 0.8 | 0.967 | 0.038 | 0.021 | 0.55 | 1.9 | 2.7 | 33.3 | 94% | 47% | 0.50 | 1.00 |

TABLE 4-continued

| Toner | Median diameter [μm] | Span value | Degree of circularity | σs [C/m²] | σl [C/m²] | σl/σs [—] | Qs [fC] | Ql [fC] | Q/M [μC/g] | Cs [%] | Cl [%] | Cl/Cs [—] | CAl/CAs [—] |
|---|---|---|---|---|---|---|---|---|---|---|---|---|---|
| 6 | 5.5 | 0.8 | 0.967 | 0.038 | 0.022 | 0.58 | 1.6 | 2.3 | 30.6 | 46% | 46% | 1.00 | 0.30 |
| 7 | 4.5 | 0.8 | 0.968 | 0.041 | 0.03 | 0.73 | 1.6 | 3.0 | 40.2 | 92% | 69% | 0.75 | 1.00 |
| 8 | 4.5 | 0.8 | 0.968 | 0.037 | 0.027 | 0.73 | 1.4 | 2.5 | 26.3 | 69% | 46% | 0.67 | 1.00 |
| 9 | 4.5 | 0.8 | 0.968 | 0.033 | 0.023 | 0.70 | 1.4 | 2.5 | 25.1 | 46% | 46% | 1.00 | 1.00 |
| 10 | 4.5 | 0.8 | 0.968 | 0.037 | 0.026 | 0.70 | 1.5 | 2.5 | 37.5 | 46% | 46% | 1.00 | 0.60 |
| 11 | 3.1 | 0.8 | 0.970 | 0.042 | 0.03 | 0.71 | 2.0 | 2.9 | 65.2 | 63% | 63% | 1.00 | 1.00 |
| 12 | 5.9 | 0.8 | 0.965 | 0.033 | 0.024 | 0.73 | 1.4 | 2.7 | 28.3 | 60% | 60% | 1.00 | 1.00 |
| 13 | 4.5 | 0.8 | 0.968 | 0.031 | 0.024 | 0.78 | 1.2 | 2.3 | 41.1 | 61% | 61% | 1.00 | 1.00 |
| 14 | 4.5 | 0.8 | 0.968 | 0.021 | 0.022 | 1.05 | 0.7 | 1.3 | 18.3 | 61% | 61% | 1.00 | 1.00 |
| 15 | 4.5 | 0.8 | 0.968 | 0.024 | 0.03 | 1.25 | 1.0 | 1.5 | 21.2 | 46% | 77% | 1.67 | 1.00 |
| 16 | 4.5 | 0.8 | 0.968 | 0.045 | 0.036 | 0.80 | 1.4 | 3.2 | 73.2 | 98% | 98% | 1.00 | 1.00 |

<Example of Production: Carrier>

<Example of Production: Magnetic Core Particles 1>

Step 1 (Weighing and Mixing Step)

$Fe_2O_3$: 62.7 parts $MnCO_3$: 29.5 parts $Mg(OH)_2$: 6.8 parts $SrCO_3$: 1.0 parts These ferrite raw materials were respectively weighed so as to meet the compositional ratios. The materials were then pulverized and mixed for five hours with a dry vibrating mill and stainless beads of ⅛ inch in diameter.

Step 2 (Calcining Step)

A roller compactor was used to form the pulverized mixture into a pellet in the size of approximately 1 mm square. Coarse particles were removed from this pellet with a shaking screen having the aperture of 3 mm, and fine particles were then removed from this pellet with a shaking screen having the aperture of 0.5 mm. Then, this pellet was fired at 1,000° C. for four hours in a nitrogen atmosphere (oxygen concentration: 0.01 vol. %) in a burner firing furnace to produce a calcined ferrite. This calcined ferrite has the following composition;

$$(MnO)_a(MgO)_b(SrO)_c(Fe_2O_3)_d,$$

where a=0.257, b=0.117, c=0.007, and d=0.393.

Step 3 (Pulverizing Step)

The calcined ferrite obtained as described above was crushed with a crusher into coarse particles of approximately 0.3 mm. Then, 30 parts of water was added to 100 parts of the calcined ferrite, and the water-added ferrite was pulverized for one hour with a wet ball mill and zirconia beads of ⅛ inch in diameter. Then, obtained slurry was pulverized for four hours with a wet ball mill and alumina beads of 1/16 inch in diameter to obtain a ferrite slurry (finely pulverized product of the calcined ferrite).

Step 4 (Particle Formation Step)

Then, 1.0 parts of ammonium carboxylate; dispersant, and 2.0 parts of polyvinyl alcohol; binder, to 100 parts of the calcined ferrite were added to the ferrite slurry, and the resulting ferrite slurry was pulverized into spherical particles with a spray dryer (OHKAWARA KAKOHKI CO., LTD.) The obtained particles after size control were heated at 650° C. for two hours to remove the organic components including the dispersing agent and binder.

Step 5 (Firing Step)

The spherical particles obtained in Step 4 were fired in an electric furnace. To control the firing atmosphere, the temperature of the electric furnace was raised from room temperature to 1,300° C. in the course of two hours in a nitrogen atmosphere (1.00 vol. % of oxygen concentration) and was then kept at 1,150° C. for four hours and then dropped to 60° C. in the course of four hours to replace the nitrogen atmosphere with atmosphere. The particles were collected from the furnace at 40° C. or less.

Step 6 (Selecting Step)

The agglutinated spherical particles were crushed, and any poorly magnetic particles were selected and removed by magnetic separation, and then, coarse particles were removed with a screen having the aperture of 250 μm. As a result, magnetic core particles 1 were obtained, in which 50% particle sizes in terms of volumetric distribution were 37.0 μm.

<Preparation of Coating Resin 1>

Cyclohexyl methacrylate monomer: 26.8 mass %

Methyl methacrylate monomer: 0.2 mass %

Methyl methacrylate macromonomer (macromonomer having methacryloyl group at one terminal and having the mass-average molecular weight of 5,000): 8.4 mass %

Toluene: 31.3 mass %

Methylethylketone: 31.3 mass %

These materials were put in a four-necked flask equipped with a reflux cooler, temperature gage, nitrogen introducing tube, and stirrer. Then, nitrogen gas was introduced into the flask to create an adequate nitrogen atmosphere inside of the flask. Next, the flask was heated to 80° C., and 2.0 mass % of azobisisobutyronitrile was added to the flask and refluxed for five hours for polymerization. Then, hexane was added to the obtained reactant to induce copolymer precipitation, and the obtained precipitate was separated by filtering and vacuum-dried to obtain a coating resin 1.

Next, 30 parts of the coating resin 1 was dissolved in 40 parts of toluene and 30 parts of methylethylketone to obtain a polymer solution 1 (solid content: 30 mass %).

<Preparation of Coating Resin Solution 1>

Polymer solution 1 (resin solid concentration: 30%): 33.3 mass %

Toluene: 66.4 mass %

Carbon black, Regal 330 (Cabot Corporation, primary particle size: 25 nm, nitrogen sorption specific surface area: 94 $m^2/g$, DBP oil absorption: 75 mL/100 g): 0.3 mass %

These materials were subjected to dispersion for one hour using a paint shaker and zirconia beads of 0.5 mm in diameter. The obtained dispersing solution was filtered through a 5.0-μm membrane filter to obtain a coating resin solution 1.

<Example of Production: Magnetic Carrier 1>

(Resin Coating Step):

The magnetic core particles 1 and the coating resin solution 1 were put in a vacuum deaeration kneader kept at normal temperature (the coating resin solution was added so that the resin component ratio was 2.5 parts relative to 100 parts of the magnetic core particles 1). The mixture in the kneader was stirred at 30 rpm for 15 minutes. After at least a certain content of solvent (80 mass %) was volatilized, the mixture was heated to 80° C. while being mixed under reduced pressure. Then, toluene was distilled off in the course of two hours, and the mixture was then cooled. Any poorly magnetic particles were selected and removed from the obtained magnetic carrier by magnetic separation, and the resulting magnetic carrier was passed through a screen having the aperture of 70 μm, and then classified with a wind classifier to obtain a magnetic carrier 1 in which 50% particle sizes in terms of volumetric distribution (D50) were 38.2 μm.

<Example of Production: Two-Component Developer 1>

A two-component developer 1 was obtained by mixing 92.0 parts of the magnetic carrier 1 and 8.0 parts of the toner 1 using a V-type mixer (V-20, SEISHIN ENTERPRISE CO., LTD.).

<Example of Production: Two-Component Developers 2 to 16>

As in the production of the two-component developer 1, the toners 1 to 16 and the magnetic carrier 1 were similarly combined as shown in Table 5 to obtain two-component developers 2 to 16 of working examples 1 to 12 and comparative examples 1 to 4.

TABLE 5

| Working example or Comparative example | Two-component developer | Toner | Magnetic carrier |
|---|---|---|---|
| Working example 1 | 1 | 1 | 1 |
| Working example 2 | 2 | 2 | 1 |
| Working example 3 | 3 | 3 | 1 |
| Working example 4 | 4 | 4 | 1 |
| Working example 5 | 5 | 5 | 1 |
| Working example 6 | 6 | 6 | 1 |
| Working example 7 | 7 | 7 | 1 |
| Working example 8 | 8 | 8 | 1 |
| Working example 9 | 9 | 9 | 1 |
| Working example 10 | 10 | 10 | 1 |
| Working example 11 | 11 | 11 | 1 |
| Working example 12 | 12 | 12 | 1 |
| Comparative example 1 | 13 | 13 | 1 |
| Comparative example 2 | 14 | 14 | 1 |
| Comparative example 3 | 15 | 15 | 1 |
| Comparative example 4 | 16 | 16 | 1 |

<Evaluation of Developers>

The two-component developers 1 to 16 of the working examples 1 to 12 and comparative examples 1 to 4 thus produced were evaluated as described below.

An image formation apparatus used then was a remodeled version of a digital commercial printer, imageRUNNER ADVANCE C5560, supplied by Canon Marketing Japan Inc., in which the following features are optionally settable; fixing temperature, processing speed, direct-current voltage $V_{DC}$ of developer support, charging voltage $V_D$ of electrostatic latent image-bearing member, and laser power. As for image output evaluation, an FFh image (solid-printing image) having a desired image ratio was outputted, and the $V_{DC}$, $V_D$, and laser power were adjusted so as to have a desired amount of toner loaded on the FFh image. The FFh image was then evaluated as described later. The FFh refers to hexadecimal values of 256 gradations. Of the 256 gradations, 00h represents the first gradation (white part) and FFh represents the 256th gradation (solid-printing part).

[Fog Preventability]

The two-component developers of the respective examples were each put in a developer container for black in the image formation apparatus, and each image for evaluation described above was outputted to evaluate the occurrence of fog.

Paper: CS-680 (68.0 g/m$^2$, Canon Marketing Japan Inc.)

Image evaluation: 00h image printed all over this approximately letter-sized paper Vback: 150 V (adjusted by controlling the direct-current voltage $V_{DC}$ of developer support, charging voltage $V_D$ of electrostatic latent image-bearing member, and laser power)

Test environment: high temperature, high humidity (temperature: 30° C., humidity: 80% RH)

Fixing temperature: 170° C.

Processing speed: 377 mm/sec.

Fog values defined below were used as indicators to evaluate fog preventability.

First, an average reflectivity Ds (%) of paper for evaluation before paper feed was measured, and an average reflectivity Dr (%) of paper for evaluation after paper feed was then measured with a reflectometer (Model TC-6DS, Tokyo Denshoku CO., LTD.). Then, a value calculated by the following formula was defined as a fog value, and the calculated fog value was evaluated according to the evaluation criteria below.

$$Fog\ \text{value} = Dr(\%) - Ds(\%)$$

(Criteria for Evaluation)

A: Fog value of less than 0.3% (excellent)

B: Fog value of 0.3% or more and less than 0.5% (very good)

C: Fog value of 0.5% or more and less than 0.8% (good)

D: Fog value of 0.8% or more and less than 1.2% (fair)

E: Fog value of 1.2% or more (poor)

[Transferability]

The two-component developers were each put in a developer container for cyan in the image formation apparatus to evaluate transferability under the following conditions.

Paper: Image evaluation using GF-0081 (81.0 g/m$^2$, Canon Marketing Japan Inc.) Toner loading amount in solid-printing image: 0.35 mg/cm$^2$ Primary transfer current: 30 μA Test environment: normal temperature, normal humidity (temperature: 23° C., humidity: 50% RH)

Processing speed: 377 mm/sec.

The toner left on the photoreceptor afterwards and the toner prior to the primary transfer were stripped off with an adhesive tape made of polyester. The adhesive tape was peeled off and attached to the paper, and the concentration of the transferred image was measured with a spectral densitometer, 500 series (X-Rite, Incorporated).

A rate of change between concentrations of the image prior to the primary transfer and of the transferred image remaining after the transfer was defined as a transfer efficiency, which was evaluated according to the following criteria.

A: Transfer efficiency of 90% or more

B: Transfer efficiency of 85% or more and less than 90%

C: Transfer efficiency of 80% or more and less than 85%

D: Transfer efficiency of less than 80%

<Image Concentration Stability>

The two-component developers were each put in a developer container for cyan in the image formation apparatus, and each image for evaluation described above was outputted to evaluate stability in image concentration.

Paper: GFC-081 (81.0 g/m$^2$, Canon Marketing Japan Inc.)

Vcontrast: 350 V (adjusted by controlling the direct-current voltage $V_{DC}$ of developer support, charging voltage $V_D$ of electrostatic latent image-bearing member, and laser power)

Evaluated image: image of 2 cm×5 cm located at the center of the approximately letter-sized paper Test environment: normal temperature, normal humidity (temperature: 23° C., humidity: 50% RH)

Fixing temperature: 170° C.

Processing speed: 377 mm/sec.

An image concentration value was used as an indicator for evaluation. The image concentration at the center was measured with an X-Rite color reflective densitometer (500 series, X-Rite, Incorporated). The values of the obtained image concentrations were evaluated according to the following criteria.

(Criteria for Evaluation)

A: Image concentration value of 1.35 or more (excellent)

B: Image concentration value of 1.30 or more and less than 1.35 (good)

C: Image concentration value of 1.25 or more and less than 1.30 (Fair)

D: Image concentration value of less than 1.25 (poor)

[Dot Reproducibility]

The two-component developers were each put in a developer container for cyan in the image formation apparatus, and each image for evaluation described above was outputted to evaluate its image quality.

Paper: GFC-081 (81.0 g/m$^2$, Canon Marketing Japan Inc.)

Vcontrast: 300 V (adjusted by controlling the direct-current voltage $V_{DC}$ of developer support, charging voltage $V_D$ of electrostatic latent image-bearing member, and laser power)

Evaluated image: one-dot, one-space vertical line image located on the approximately letter-sized paper Test environment: normal temperature, normal humidity (temperature: 23° C., humidity: 50% RH)

Fixing temperature: 170° C.

Processing speed: 377 mm/s

A blur value (numerical value defined by ISO 13660 that indicates a degree of blur of line) was used as an indicator for evaluation of dot reproducibility. The blur values were measured with Personal IAS (image analysis system, Quality Engineering Associates Inc.) and evaluated according to the following criteria for evaluation.

(Criteria for Evaluation)

A: Blur value of less than 35 μm (excellent)

B: Blur value of 35 μm or more and less than 38 μm (good)

C: Blur value of 38 μm or more and less than 41 μm (fair)

D: Blur value of 41 μm or more (poor)

Table 6 shows the evaluation result.

TABLE 6

| | Transferability | | | | Image concentration | | | |
|---|---|---|---|---|---|---|---|---|
| | Fog preventability | | Transfer | | Image | | Dot reproducibility | |
| | | Fog value [%] | | efficiency [%] | | concentration [—] | | Blur value [μm] |
| Working example 1 | A | 0.0% | A | 96% | A | 1.40 | A | 31 μm |
| Working example 2 | A | 0.0% | A | 94% | A | 1.40 | A | 31 μm |
| Working example 3 | A | 0.0% | A | 94% | A | 1.40 | A | 31 μm |
| Working example 4 | A | 0.2% | A | 94% | A | 1.40 | A | 33 μm |
| Working example 5 | A | 0.0% | A | 92% | A | 1.40 | A | 34 μm |
| Working example 6 | A | 0.0% | A | 91% | A | 1.40 | A | 31 μm |
| Working example 7 | A | 0.1% | C | 84% | B | 1.33 | B | 35 μm |
| Working example 8 | C | 0.7% | C | 84% | A | 1.38 | B | 36 μm |
| Working example 9 | C | 0.7% | C | 84% | A | 1.36 | B | 36 μm |
| Working example 10 | C | 0.7% | C | 84% | A | 1.39 | A | 32 μm |
| Working example 11 | C | 0.7% | C | 84% | A | 1.40 | B | 35 μm |
| Working example 12 | B | 0.3% | B | 88% | A | 1.38 | C | 39 μm |
| Comparative example 1 | D | 0.8% | C | 83% | A | 1.36 | A | 31 μm |
| Comparative example 2 | E | 1.2% | D | 72% | C | 1.28 | B | 35 μm |
| Comparative example 3 | E | 1.4% | D | 75% | D | 1.23 | C | 38 μm |
| Comparative example 4 | E | 1.4% | D | 76% | D | 1.22 | D | 41 μm |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-081288, filed Apr. 22, 2019, Japanese Patent Application No. 2018-152731, filed Aug. 14, 2018, and Japanese Patent Application No. 2019-128583, filed Jul. 10, 2019, which are hereby incorporated by reference herein in their entirety.

What is claimed is:

1. A toner comprising a toner particle and an external additive, the toner satisfying a relationship expressed by the following formula (1);

$$0.10 \leq \sigma l/\sigma s \leq 0.75 \quad (1),$$

where when the toner is divided into two groups, i.e. a first group and a second group with an inertial classifier, the first group including a larger size of the toner particles, and the second group including smaller size of the toner particles, and the number of the toner particles in the first group being substantially equal to the number of the toner particles in the second group, $\sigma l$ (C/m$^2$) represents an absolute value of average surface charge density of the toner included in the first group, and $\sigma s$ (C/m$^2$) represents an absolute value of average surface charge density of the toner included in the second group.

2. The toner according to claim 1, wherein a median diameter D50 of the toner in terms of particle number is 3.0 μm or more and 6.0 μm or less.

3. The toner according to claim 1, wherein a median diameter D50 of the toner in terms of particle number is 3.0 μm or more and 5.0 μm or less.

4. The toner according to claim 1, wherein an absolute value Qs of an average electric charge amount per toner particle included in the second group is 1.4 fC or more.

5. The toner according to claim 1, wherein an absolute value Ql of an average electric charge amount per toner particle included in the first group is 2.8 fC or less.

6. The toner according to claim 1, wherein the values of σl and σs satisfy a relationship expressed by the following formula (2);

$$0.10 \leq \sigma l/\sigma s \leq 0.67 \quad (2).$$

7. The toner according to claim 1, wherein the value of σs is 0.038 $C/m^2$ or more.

8. The toner according to claim 1, wherein the value of σl is 0.028 $C/m^2$ or less.

9. The toner according to claim 1, wherein an absolute value of an electric charge amount per unit mass Q/M of the toner is 70 μC/g or less, when, in an environment at 23° C. and at 50% RH, 0.7 g of the toner and 9.3 g of a standard carrier (N-01) according to Imaging Society of Japan are put in a polyethylene bottle having the capacity of 50 mL and are shaken at 200 rpm for five minutes with a shaker to be electrically charged by friction.

10. The toner according to claim 1, wherein a span value of the toner expressed by the following formula (3) is 0.7 or more and 2.0 or less;

$$(D90-D10)/D50 \quad (3),$$

where D90 is a particle size on cumulative 90% in terms of particle number, and D10 is a particle size on cumulative 10% in terms of particle number.

11. The toner according to claim 1, wherein the external additive includes an external additive having negative chargeability.

12. The toner according to claim 11, wherein the external additive in the second group has a higher degree of negative chargeability than the external additive in the first group.

13. The toner according to claim 11, wherein the toner included in the first group is coated with silica particles having a water absorption content of 1.0% or more, and the toner included in the second group is coated with silica particles having a water absorption content of 0.5% or less.

14. The toner according to claim 11, wherein values of Cs and Cl satisfy a relationship expressed by the following formula (4);

$$0.10 \leq Cl/Cs \leq 0.80 \quad (4),$$

where the Cl is a coating ratio of the toner included in the first group with the external additive having negative chargeability, and the Cs is a coating ratio of the toner included in the second group with the external additive having negative chargeability.

15. The toner according to claim 14, wherein the values of Cs and Cl satisfy a relationship expressed by the following formula (5);

$$0.10 \leq Cl/Cs \leq 0.67 \quad (5).$$

16. The toner according to claim 1, further comprising a charge control agent having chargeability, wherein values of CAs and CAl satisfy a relationship expressed by the following formula (6);

$$0.10 \leq CAl/CAs \leq 0.80 \quad (6),$$

where the CAl is a content of the charge control agent in the toner included in the first group, and the CAs is a content of the charge control agent in the toner included in the second group.

17. The toner according to claim 16, wherein the values of CAs and CAl satisfy a relationship expressed by the following formula (7);

$$0.10 \leq CAl/CAs \leq 0.50 \quad (7).$$

* * * * *